United States Patent [19]

Off et al.

[11] 4,451,319

[45] May 29, 1984

[54] SYSTEM FOR PREFABRICATING POCKET WELTS AND FACING STRIPS

[75] Inventors: Joseph W. A. Off, Irving; Judson H. Early, Dallas, both of Tex.

[73] Assignee: Haggar Company, Dallas, Tex.

[21] Appl. No.: 343,573

[22] Filed: Jan. 28, 1982

Related U.S. Application Data

[63] Continuation-in-part of Ser. No. 304,095, Sep. 21, 1981.

[51] Int. Cl.[3] ..... B26D 5/00; B32B 31/00; B65H 25/00; A41D 27/20

[52] U.S. Cl. ..... 156/353; 156/358; 156/361; 156/519; 156/552; 2/247

[58] Field of Search ..... 156/358, 351, 360, 361, 156/364, 443, 227, 519, 552, 554, 353; 29/430; 2/247

[56] References Cited

U.S. PATENT DOCUMENTS

| | | | |
|---|---|---|---|
| 3,697,354 | 10/1972 | Bown | 156/365 |
| 3,708,372 | 1/1973 | Contreras | 156/361 |
| 4,093,493 | 6/1978 | Welch et al. | 156/358 |
| 4,141,775 | 2/1979 | Williams et al. | 156/358 |
| 4,226,661 | 10/1980 | Off et al. | 156/358 |
| 4,263,678 | 4/1981 | Off | 2/247 |
| 4,301,958 | 11/1980 | Hatakenaka et al. | 29/430 |
| 4,316,756 | 2/1982 | Wilson | 156/227 |

*Primary Examiner*—Edward C. Kimlin
*Assistant Examiner*—Louis Falasco
*Attorney, Agent, or Firm*—Richards, Harris & Medlock

[57] ABSTRACT

In a system (300) for prefabricating strings of pocket welts on a continuous basis, the assembly proceeds along one side of a table (12). Adhesive backed fabric tape (48) from a supply reel (50) is indexed into a bonding station where sections of fabric (154) are positioned by photoelectric sensors (306, 308) and adhesively attached to the fabric tape. The fabric tape (48) is indexed to an adhesive application station (310) where an adhesive layer is bonded to the fabric tape and the backing layer separated at a backing separator (356). The fabric tape (48) then moves to a bonding/folding station (420) where the fabric pieces are folded and bonded to form the welts. Forward and rearward centering assemblies (424,426) employ front and rear positioning fingers (428, 430) to center the fabric tape in the folding/bonding station (420).

17 Claims, 26 Drawing Figures

48
150
152
154
171
20
72
156
158
160
162
164
166
168
170
110'
86'
132'
138'
124'
126'
130'
120'
122
112'
90'
92'
96'
98'
106'
100'
94'
88'
84'
82'
80'
78'
9
14
50
72'
110'

SYSTEM FOR PREFABRICATING POCKET WELTS AND FACING STRIPS

CROSS REFERENCE TO RELATED APPLICATIONS

This application is a continuation-in-part of allowed U.S. patent application Ser. No. 304,095 filed Sept. 21, 1981.

TECHNICAL FIELD

The present invention relates generally to a system for manufacturing garment components, and more particularly to an apparatus and method for continuously prefabricating separate strings of interconnected, spaced apart welts and facing strips for use in constructing pockets in garments.

BACKGROUND ART

The manufacture of garments traditionally has been characterized by various manual operations including material cutting, positioning, sewing and trimming. Such manual operations are both time consuming and expensive in terms of their contribution to the overall cost of manufacturing a garment. For example, a significant portion of the production cost of a pair of trousers, shorts or a jacket can be attributed to the expense associated with constructing and finishing the pockets therein. Since the garment industry is characterized by high volume production, it will be appreciated that the cost of fabricating garment components such as pockets, belt loops, epaulets, waist bands and the like represents considerable expense.

In an attempt to improve upon the manual sewing techniques of the prior art, efforts have been directed toward automating various aspects of garment fabrication and incorporating adhesive as a supplement or complete substitute for mechanically sewn stitches. For example, U.S. Pat. Nos. 3,880,697 and 3,993,526 relate to a system for making bonded belt loops in which strips of belt loop material and interfacing material are transported through a folder and around a revolving heated drum which activates adhesive on the interfacing material to form bonded belt loops. U.S. Pat. No. 4,156,293 discloses a pocket construction wherein a garment panel and rectangular pocket blank are secured together and manually formed into a finished pocket through various folding and adhesive connection steps. U.S. Pat. No. 4,226,661 shows an apparatus for manufacturing on a continuous basis prefabricated pocket bags like that shown in the forementioned '293 patent. U.S. Pat. No. 4,315,793, discloses an apparatus for integrating prefabricated pocket bags into garment panels on a semi-automatic basis wherein each pocket bag and corresponding garment panel are releasably clamped together and manually advanced through various work stations. Co-pending application Ser. No. 170,750 discloses an apparatus for transporting and indexing a plurality of sets of garment panels and prefabricated pocket bags through various work stations to form garment panels with finished pockets constructed therein. All of these inventions are assigned to Haggar Company of Dallas, Tex.

A good deal of developmental work thus has been directed toward reducing the cost associated with constructing belt loops and especially pockets of garments, with comparatively little attention having been focused upon the remaining component elements of the pockets. Although adhesive connection techniques have been employed in general heretofore, the construction of pocket welts and facing strips has been carried out manually and thus has still contributed significant expenses to the cost of constructing the pockets themselves. A system is therefore needed which automatically prefabricates continuous strings of pocket welts and facing strips for subsequent use in the pocket construction stage of garment manufacture.

SUMMARY OF INVENTION

The present invention comprises a system for prefabricating garment components which overcomes the foregoing and other difficulties associated with the prior art. In accordance with the invention, there is provided an apparatus and method for assembling on a continuous basis strings of pocket welts and facing strips for subsequent use in constructing of pockets in garment panels. This system is particularly adapted to serve, along with the one shown in U.S. Pat. No. 4,226,661, as a peripheral support device to an apparatus for automatically constructing pockets in garment panels.

More particularly, the present invention comprises a system for prefabricating continuous strings of pocket welts and facing strips on a semi-automatic basis. Welts are fabricated on one side of the apparatus, with facing strips being fabricated on the opposite side. A supply roll of tape with adhesive on one side thereof is provided for each side of the apparatus. Each tape is withdrawn from the supply reel and indexed to a bonding station where a section of fabric is positioned beneath the tape by an operator before the tape and fabric section are adhesively connected and bonded together. Separate transfer assemblies index the tapes. The string of facing strips on one tape, which is completed as each section of fabric is attached to the tape, is wound onto a takeup reel. The semifinished welts on the other tape are first advanced through a cutter to trim each section of fabric and then through an adhesive application/folding station to fold the fabric around the tape and adhesively secure it in place and thus complete formation of the string of pocket welts before being wound onto another takeup reel.

In accordance with another aspect of the present invention, a welt position sensor is provided to ensure proper placement of the welt in the system. A second tape path is provided for movement of a tape having an adhesive on one side and a backing layer parallel the path of the fabric in the adhesive application/folding station. A traversing cutter wheel is provided to cut through the adhesive layer on the second tape to permit ready separation of the adhesive and backing layer. The adhesive on the second tape is bonded to the first tape and the backing is then separated and disposed of. Positioning fingers center the tape and fabric within the folding station for folding.

BRIEF DESCRIPTION OF DRAWINGS

A more complete understanding of the invention can be had by referring to the following Detailed Description together with the accompanying Drawings, wherein.

DETAILED DESCRIPTION

Figure 1:
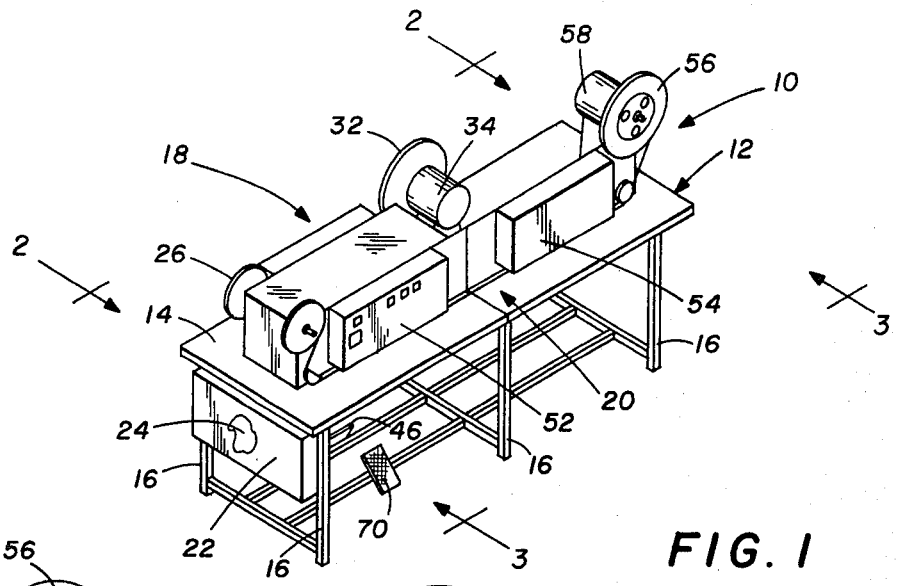
FIG. 1 is a perspective view of a system for prefabricating welts and facing strips incorporating the invention.
Figure 2:
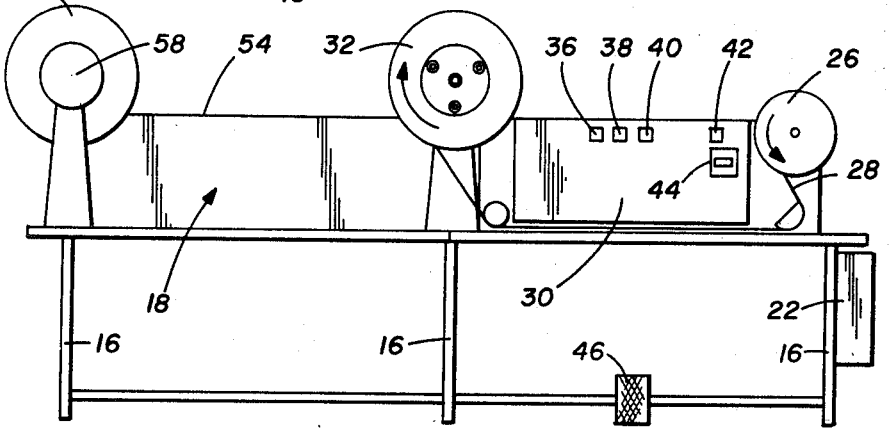
FIG. 2 is a reduced elevational view of one side of the system.
Figure 3:
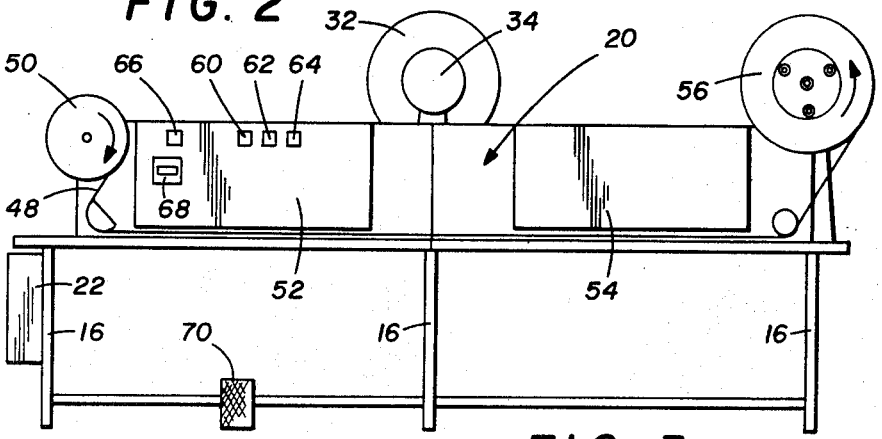
FIG. 3 is a reduced elevational view of the other side of the system.

Referring now to the Drawings, wherein like reference numerals designate corresponding elements throughout the views, and particularly referring to FIGS. 1–3, there is shown the system 10 incorporating a first embodiment of the invention. System 10 is particularly adapted for continuous, semiautomatic fabrication of strings of pocket welts and facing strips which are then integrated with pocket bags to form finished pockets in garment panels.

System 10 is mounted on a table 12 comprising a top 14 supported by legs 16. The facing strip fabrication assembly 18 is located along one side of table 12 while the welt fabrication assembly 20 is located along the other side. Strings of facing strips or strings of welts alone can be fabricated with system 10, as can both strings of welts and facings strips simultaneously. Each side of system 10 thus comprises an important aspect of the invention. A cabinet 22 is located at the forward end of table 12 for housing a microprocessor 24 which controls system 10. Microprocessor 24 can comprise an Intel Model 4004 or Zilog Z-80 microprocessor controller.

FIG. 2 is a general elevational view of the facing strip fabrication assembly 18 of system 10. A supply reel 26 of adhesive-backed paper tape 28 is located at the front end of the assembly. Tape 28 from reel 26 is withdrawn and directed along a path through work stations behind cover 30 to secure sections of fabric to the tape before being wound onto a takeup reel 32. Motor 34 drives takeup reel 32. Four buttons, 36, 38, 40 and 42 and a counter 44 are located on cover 30 for use by an operator standing adjacent to that side of table 12. Button 36 is utilized when threading tape 28 between reels 26 and 32 to initiate assembly 18 for operation. Button 38 comprises a stop button for deactivating assembly 18 of system 10 in the event of a hangup or other emergency. Button 40 is utilized to jog tape 28 forward as desired, while the motor 34 of the takeup reel 32 is controlled with button 42. A foot switch 46 is provided beneath table 12 for use by the operator in controlling advancement of tape 28 through assembly 18.

FIG. 3 is a general elevational view of the welt fabrication assembly 20 of system 10 which, at the forward end thereof, is similar in some respects to assembly 18. Adhesive backed fabric tape 48 from a supply roll 50 is directed along a path between bonding, advancing, trimming, adhesive applicating, and folding/bonding stations located behind covers 52 and 54 to a takeup reel 56 which is driven by motor 58. A thread button 60, stop button 62, jog button 64 and motor on/off button 66 together with a counter 68 are provided on cover 52 for use by the operator of assembly 20 in similar fashion to the buttons and counter of assembly 18 on the opposite side of system 10. A foot switch 70 controls advancement of tape 48 through assembly 20.

Figures 4, 7:
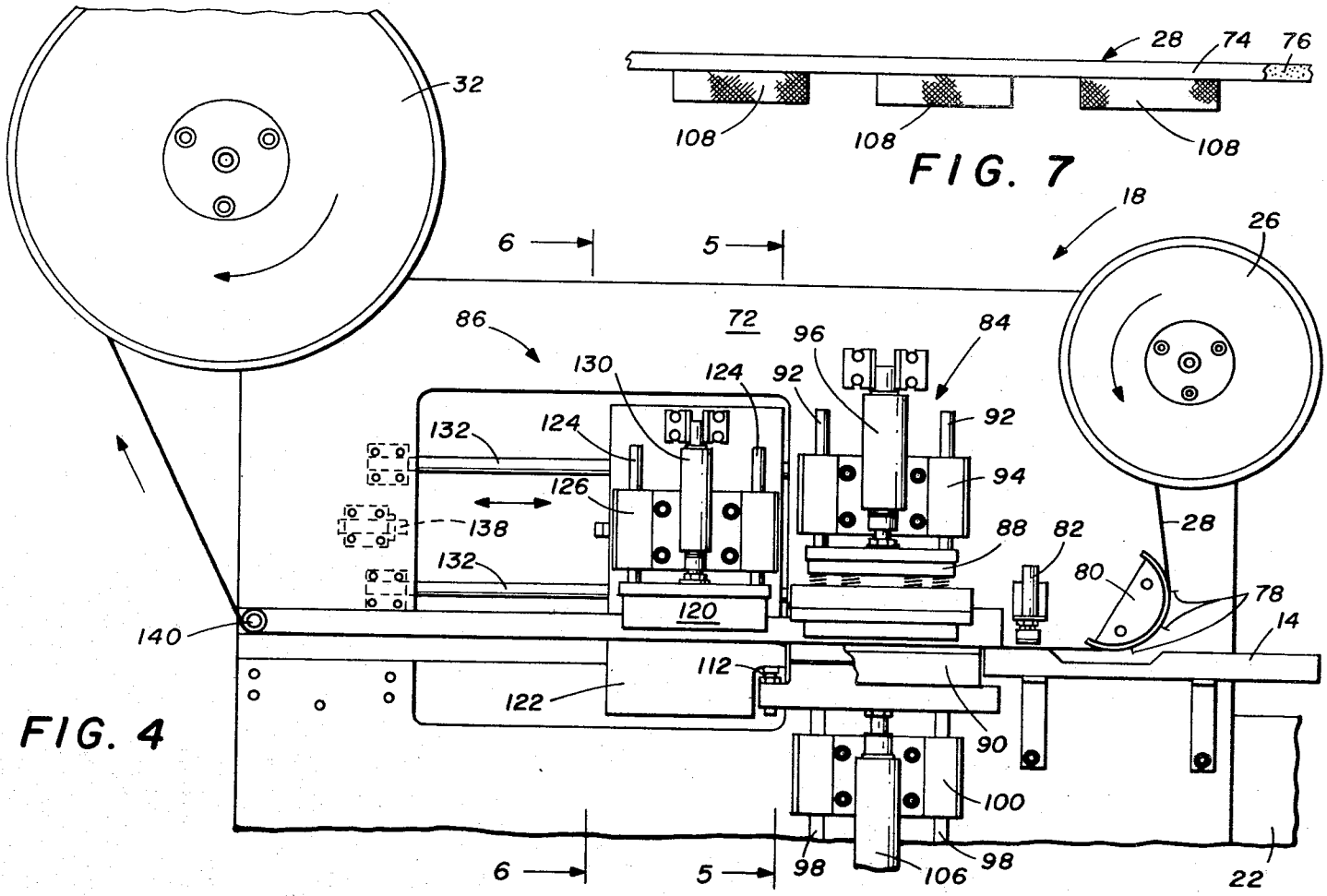
FIG. 4 is an enlarged illustration, partially cut away, of FIG. 2 showing the facing strip assembly portion of the system.
FIG. 7 is an illustration of a portion of a completed string of facing strips.

The structural details of the facing strip fabrication assembly 18 are illustrated in FIGS. 4–7. Cover 30 has been entirely omitted from FIG. 4 for clarity. The various components of assembly 18 are mounted on either the top 14 of table 12 or on a support plate 72 extending upwardly therefrom. A supply reel 26 of tape 28 is mounted for rotation at the forward end of plate 72. Tape 28 comprises a strip of paper 74 with a coating of fusible adhesive 76 on the underside thereof as is best seen in FIG. 7. Adhesive 76 can comprise nylon, polyester, polyamide, plastic or other fusible substances characterized by temporary conversion to a plastic state from a solid state upon heating. Tape similar to tape 28 can be obtained from General Fabric Fusing Company of Cincinnati, Ohio.

The adhesive backed paper tape 28 is withdrawn from supply reel 26 and fed through loops 78 on the periphery of a fixed semicircular guide 80 as is best seen in FIG. 4. From guide 80, the tape 28 extends along a straight path beneath a tape clamp 82 which comprises a resilient foot actuated by a pneumatic cylinder. Clamp 82 functions to immobilize tape 28 against the table top 14 between advancements of the tape to achieve more precise control of tape withdrawal from supply reel 26. Clamp 82 is thus mounted above the path of tape 28 and is supported by a bracket attached to plate 72.

Tape 28 extends from clamp 82 beneath a bonding subassembly 84 and then a transfer subassembly 86.

Subassembly 84 includes a cooperating head 88 mounted for vertical movement relative to an anvil 90 located on the opposite side of the tape path. Steel, aluminum, molded rubber or other suitable material can be utilized to fabricate head 88 and anvil 90. Head 88 is attached to the ends of a pair of rods 92 which are guided for movement in a block 94 attached to plate 72. Double acting cylinder 96 is coupled to head 88 for selective reciprocation thereof.

In accordance with the preferred construction, head 88 includes an internal electrical resistance element 98 and a temperature sensor or thermocouple 100 for heating the head in a controlled manner in order to activate the adhesive 76 of tape 28 upon engagement therewith. In the alternative, head 88 could be provided with an internal ultrasonic or radio frequency source, or an external source of radiation or heat could be positioned adjacent to the head for selectively activating sections of adhesive 76 on tape 28.

The backup anvil 90 of the bonding subassembly 84 is mounted in an opening in the table top 14. Anvil 90 can be fixed; however, in the preferred embodiment, the anvil is mounted for vertical movement relative to head 88. Anvil 90 is attached to the ends of a pair of rods 102 extending through a guide block 104 attached to plate 72. Reciprocation of anvil 90 is carried out by a double acting cylinder 106 coupled thereto. Anvil 90 is normally located in a recessed position beneath table top 14 to provide sufficient clearance for the operator to insert a strip of fabric comprising a facing strip 108 underneath tape 28 and against a locator block 110. Fabric strip 108 can be of either natural or synthetic material. The anvil 90 is shown in a raised position in FIG. 5, and an adjustable stop 112 is provided for limiting upward travel of the anvil.

After tape 28 has been threaded through loops 78 and around guide 80, through subassemblies 84 and 86 and onto takeup reel 32, the facing strip fabrication assembly 18 of system 10 is ready for operation. Clamp 82 is normally down, except during advancements of tape 28 by transfer subassembly 86, to prevent uncontrolled withdrawal of the tape from supply reel 26. The operator manually places a facing strip 108 on anvil 90 against block 110 and underneath tape 28, the adhesive side of which is down. The operator then activates foot switch 46 causing the bonding subassembly 84 to cycle. Anvil 90 thus raises facing strip 108 into contact with the adhesive side of tape 28 while head 88 comes down into engagement with the other side of the tape to clamp the facing strip and tape together under sufficient pressure and for adequate time to effect adhesive connection. After head 88 and anvil 90 return to their normal positions, tape 28 is ready for indexing and attachment of the next following facing strip 108 thereto.

Figure 5:
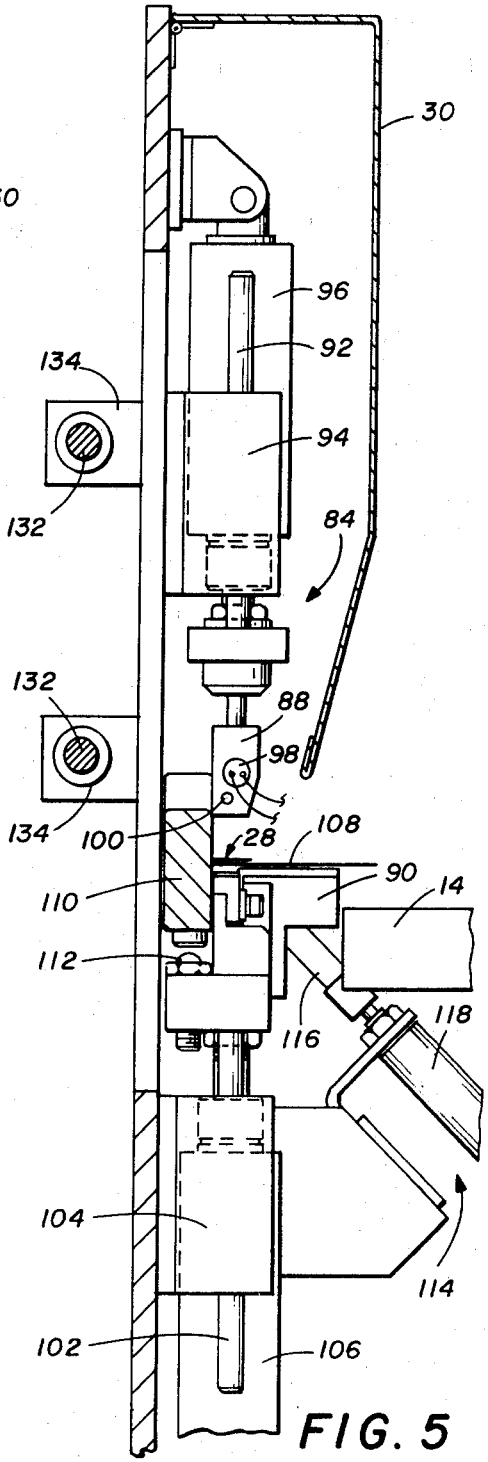

If desired, an optional alignment assembly 114 can be provided on one or both sides of anvil 90 as shown in FIG. 5. Assembly 114 comprises a flat blade 116 driven by a double acting cylinder 118 for movement relative to the tape path. Assembly 114 is oriented such that the plane of blade 116 is substantially perpendicular to the plane of tape 28 in order to insure that the tape is firmly located against block 110 during the bonding operation. The use of assembly 114, however, is optional and is not critical to practice of the invention.

Figure 6:
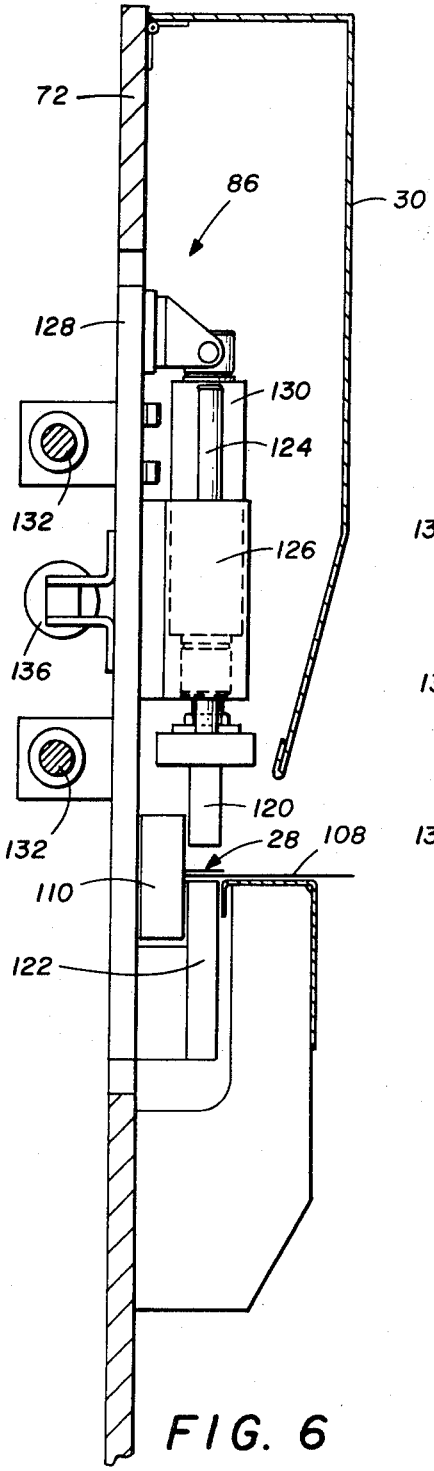
FIGS. 5 and 6 are sectional views taken along lines 5—5 and 6—6, respectively, of FIG. 4 in the direction of the arrows.

Advancement of tape 28 is effected by the transfer subassembly 86, the structural details of which are best seen in FIGS. 4 and 6. Subassembly 86 comprises a clamp bar 120 and backup anvil 122 mounted for reciprocation along the tape feedpath. The unheated clamp bar 120 is attached to the ends of a pair of rods 124 which are guided for vertical movement in blocks 126 secured to a plate 128. A double acting cylinder 130 drives the clamp bar 120. Plate 128 is mounted for sliding movement along a pair of rods 132 extending between pairs of blocks 134 secured to plate 72. Coupled between plates 72 and 128 is a double acting cylinder 136 which functions to effect reciprocation of subassembly 86 within the opening in plate 72. An adjustable stop 138, as is best seen in FIG. 4, is provided to limit travel of the transfer subassembly 86.

Foot switch 46 controls the transfer subassembly 86 as well as the bonding subassembly 84 of facing strip fabrication assembly 18. After head 88 and anvil 90 of subassembly 84 have returned to their original positions, cylinder 130 is activated to clamp the leading end of tape 28 and the edge of any facing strip 108 secured thereto between bar 120 and anvil 122, after which tape clamp 82 is released and cylinder 136 is activated to index tape 28 forward. At the end of the stroke of cylinder 136, cylinder 130 releases clamp bar 120 while tape clamp 82 is again applied before the transfer subassembly 86 returns to its original position in preparation for the next cycle. The leading end of tape 28 with facing strips 108 bonded thereto is thus drawn around roller 140 and wound onto the takeup reel 32 by motor 34 as a new section of tape is drawn from supply reel 26 and positioned beneath the bonding subassembly 84 for attachment of another facing strip.

The structural details of the welt fabrication assembly 20 are illustrated in FIGS. 8*a*–15. Covers 52 and 54 have been entirely omitted from FIGS. 8*a* and 8*b* for clarity. As stated hereinbefore, the forward end of assembly 20 is similar in some respects to the forward end of the facing strip fabrication assembly 18 on the other side of system 10. In fact the leading ends of both assemblies 18 and 20 utilize numerous component parts which are similar in construction and operation. These component parts of assembly 20 have been designated with the same reference numerals utilized in the description of assembly 18, but are distinguished therefrom by means of prime (') notations.

Figures 8A, 9, 10:
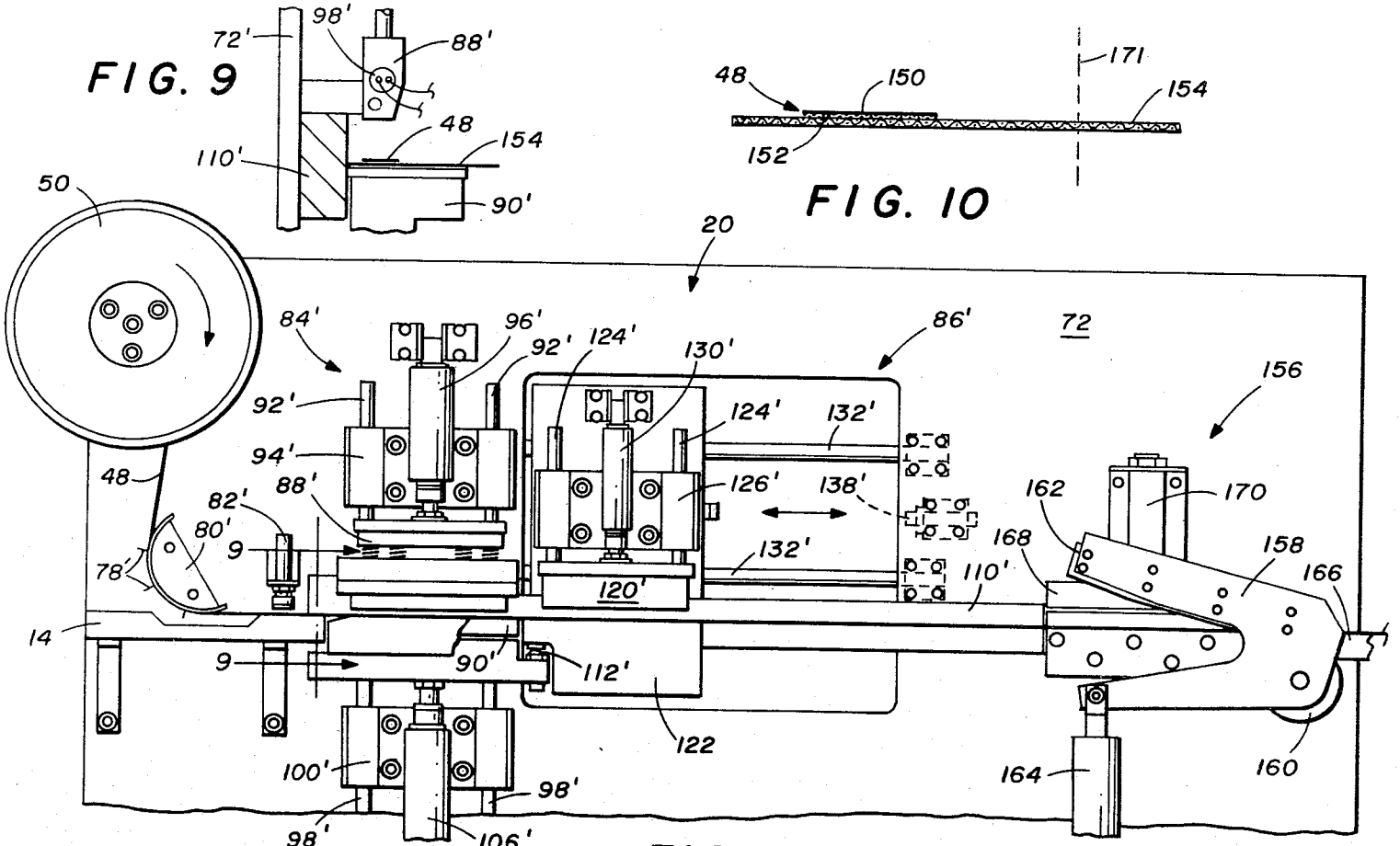
FIGS. 8*a* and 8*b* are enlarged illustrations of FIG. 3 showing the pocket welt formation portion of the system.
FIG. 9 is a sectional view taken along lines 9—9 of FIG. 8*a* in the direction of the arrows.
FIG. 10 is an enlarged cross-sectional illustration of a semi-complete string of pocket welts entering the timing station.

Adhesive backed tape 48 is withdrawn from supply reel 50 and fed through loops 78', around guide 80', beneath tape clamp 82' and through subassemblies 84' and 86' of assembly 20 in much the same fashion as is done in assembly 18. Tape 48, however, preferably comprises a strip of fabric 150 with a coating of fusible adhesive 152 on the underside thereof as is best shown in FIG. 10. Fabric 150 can be either natural or synthetic material. Adhesive 152 can comprise nylon, polyester, polyamide, plastic or other fusible substance characterized by temporary conversion from a solid state to a plastic state upon heating. Tape similar to tape 48 can be obtained from General Fabric Fusing Company of Cincinnati, Ohio.

The strips of fabric 154 from which the welts are formed, as will be explained more fully hereinafter, are positioned by the operator on anvil 90' underneath tape 48 and against the locator block 110' such that the fabric protrudes from the inner longitudinal side of the tape as can be seen in FIG. 9. The inner longitudinal edges of the strips of fabric 154 and tape 48 are thus not substantially flush as are the same edges of tape 28 and strips 108 of the facing strip fabrication assembly 18. Each strip of fabric 154 can protrude, for example, about one quarter of an inch beyond the inner edge of tape 48.

As the strips of fabric 154 are attached to tape 48, the transfer subassembly 86' incrementally advances the tape and strips through the other work stations of assembly 20, the first of which is the trimming station 156 in the preferred embodiment of the system. Station 156 comprises a V-shaped knife carrier 158 secured at one end to a pivot 160 attached to support plate 72'. A blade 162 is attached to one end of carrier 158, while a double acting cylinder 164 is coupled to the other end thereof. Tape 48 and the fabric strips 154 bonded thereto are advanced onto a support surface 166 and clamped in place with a reciprocal bar 168 driven by a double acting cylinder 170. While tape 48 is thus immobilized, cylinder 164 is actuated to pivot knife carrier 158 such that blade 162 shears the outer edge of each fabric strip 154 across the edge of the support surface 166. The dotted line 171 in FIG. 10 represents the shear line of fabric strip 154. Clamp 168 and knife carrier 158 are then returned to the position shown in FIG. 8*a* in preparation for the next advancement of tape 48. The trimming station 156 thus operates only between advancements of tape 48, and is preferably located an incremental distance from the bonding subassembly 84, so that each advancement of the tape properly positions the next fabric strip 154 for trimming.

If desired, narrower fabric strips 154 could be utilized and the trimming station 156 could be eliminated; however, the use of the trimming station permits rectangular fabric pieces of similar sizes to be used as either strips 108 in assembly 18 or strips 154 in assembly 20.

Figures 8B, 16:
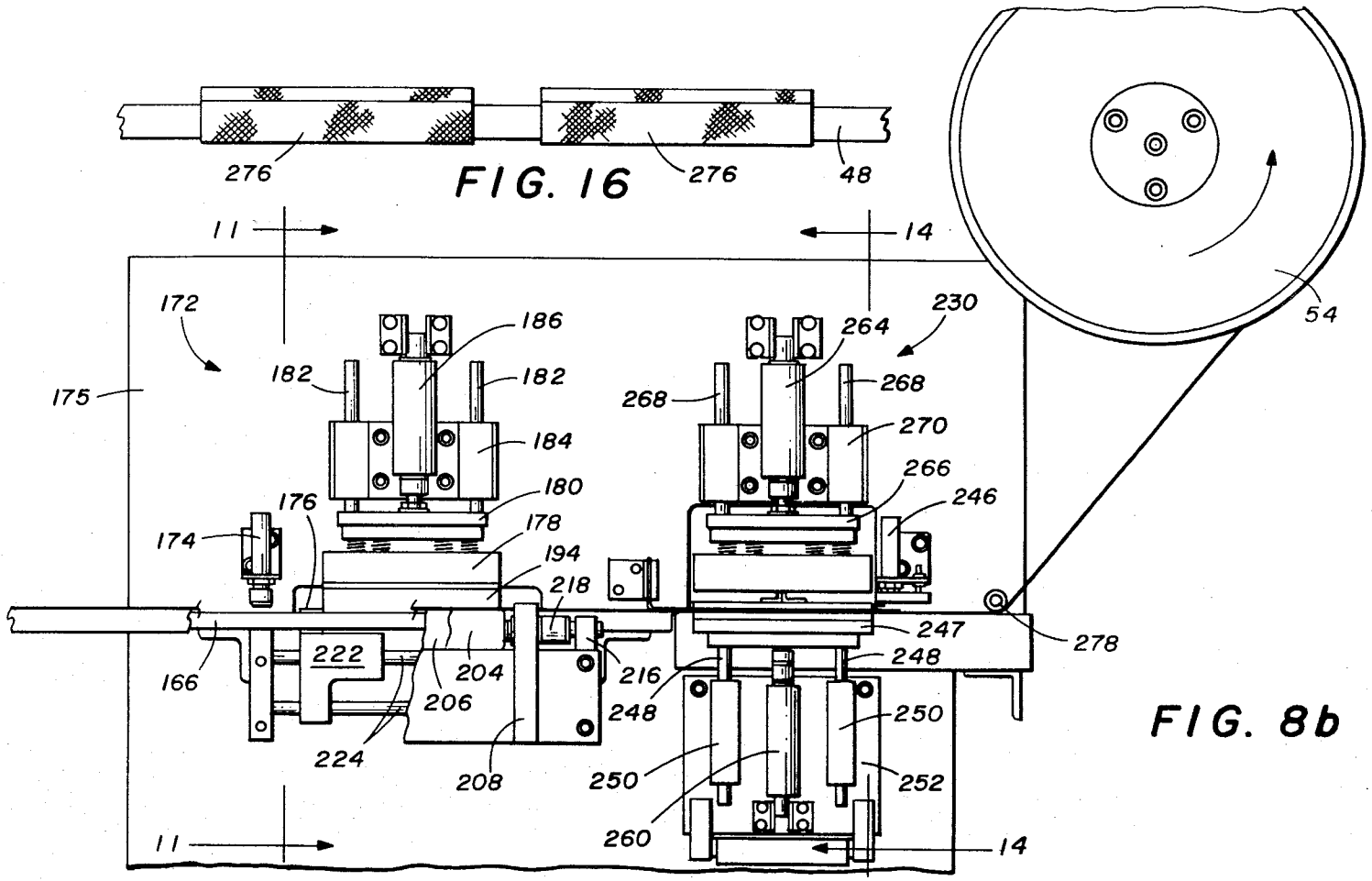
FIGS. 15 and 16 are cross-sectional and top illustrations, respectively, of a portion of a completed string of pocket welts.
Figures 11, 12, 13:
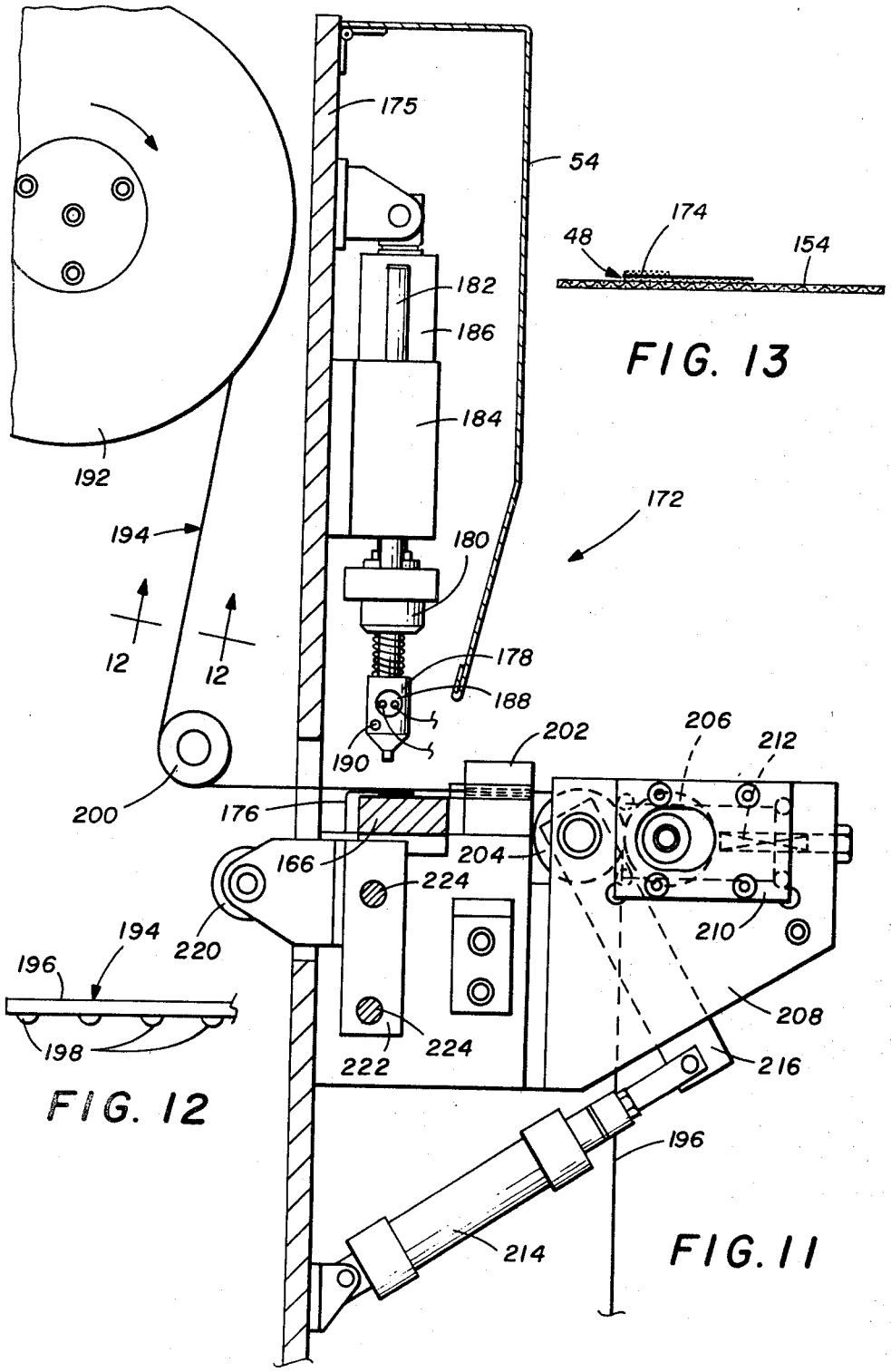
FIG. 11 is a sectional view taken along lines 11—11 of FIG. 8*b* in the direction of the arrows.
FIG. 12 is a sectional view taken along lines 12—12 of FIG. 11 in the direction of the arrows.
FIG. 13 is an enlarged cross-sectional illustration of a semi-complete string of pocket welts leaving the adhesive application station.

Referring now to FIGS. 8*b*, 11 and 12, the tape 48 and trimmed strips of fabric 154 attached thereto are advanced from the trimming station 156 to an adhesive application station 172. A strip of adhesive 174 is applied along one edge of the top side of the fabric 150 of tape 48. Tape 48 extends over a continuation of support surface 166 along a straight path beneath a tape clamp 177 and then beneath a stripper finger 176, which is mounted for movement along the path of the tape and which is positioned between the tape and a movable head 178. Clamp 177 comprises a resilient foot actuated by a double acting cylinder, and functions to immobilize the immediate section of tape when stripper finger 176 is actuated. Clamp 177 is thus mounted above the path of tape 48 and is supported by a bracket attached to a plate 175 which supports the other components of station 172.

As is best seen in FIG. 11, head 178 comprises an elongate generally rectangular member having a relatively narrow flat tip configured to engage a predetermined longitudinal zone along the top surface of fabric 150 of tape 48. Steel, aluminum, molded rubber or other suitable material can be utilized to construct head 178, which is resiliently supported by a bar 180 attached to the ends of a pair of rods 182 guided for movement in blocks 184 attached to plate 175 by four springs 179. Reciprocation of head 178 relative to the underlying support surface 166 is selectively effected with a double acting cylinder 186 coupled between bar 180 and plate 175.

In the preferred construction, head 178 includes an internal electrical resistance element 188 and a temperature sensor or thermocouple 190 for heating the head in a controlled manner in order to activate the adhesive 174 applied to the top surface of tape 48. In the alternative, head 178 could be provided with an internal ultrasonic or radio frequency source, or an external source of radiation or heat could be utilized with the head for selectively activating the adhesive 174 applied to tape 48 at station 172.

The longitudinal area of adhesive 174 added to the top surface of tape 48 is applied from a supply roll 192 of adhesive tape 194 mounted for rotation behind plate 175. Tape 194 comprises a strip of suitable carrier material 196, such as paper, with dots of fusible adhesive 198 attached to one side thereof, as is best seen in FIG. 12. The dots of adhesive 198 can be formed of nylon, polyester, polyamide, plastic or other fusible material characterized by temporary conversion from a solid state to a plastic state upon heating. Dot coated adhesive paper tape suitable for use as tape 194 can be obtained from Wendell Textile Company of Baltimore, Maryland.

The dot coated adhesive tape 194 is drawn from reel 192 around a guide roller 200 through an opening in plate 175, and from there between stripper finger 176 and reciprocal head 178. From that point tape 194 extends through a guide slot in block 202 and between a drive roller 204 and a nip roller 206. Rollers 204 and 206 are rotatably supported between a pair of brackets 208, only one of which is shown, and which also support the guide block 202. Drive roller 204 is rotatably supported in a fixed position between brackets 208, while nip roller 206 floats between a pair of carrier plates 210 attached to the brackets. Carrier plates 210 support the ends of nip roller 206 for rotation as well as movement relative to drive roller 204, and adjustable compression springs 212 are provided for urging the nip roller into firm engagement with the drive roller so that no slippage of tape 194 therebetween will occur.

Roller 204 is driven by a double acting index cylinder 214 through a crank arm 216 and a unidirectional clutch 218 which is coupled to one end of the shaft supporting the drive roller as is best seen in FIG. 8*b*. The stroke of cylinder 214 and the length of arm 216 are selected to provide a rotational drive input to roller 204 which advances the dot coated adhesive tape 194 sufficiently between successive fabric strips 154 on the tape. The index cylinder 214 thus cycles to advance the dot coated adhesive tape 194 as the fabric tape 48 is being advanced.

Cylinder 186 cycles between advancements of tapes 194 and 48 to transfer adhesive dots 198 from the backing 196 of the tape 194 onto the upper side of the fabric tape 48. Tapes 48 and 194 are then disconnected by the movable stripper finger 176, which is positioned between the tapes, as it moves along the fabric tape and across the adhesive dot coated tape under the action of the double acting cylinder 220 shown in FIG. 11. Cylinder 220 drives a sliding block 222 which is mounted on a pair of rods 224 and which supports the stripper finger 176. Tape clamp 177 is actuated immediately prior to and during actuation of the stripper finger 176 to stabilize the fabric tape 48. After the heated head 178, stripper finger 176 and tape clamp 177 have cycled tapes 48 and 194 can be advanced again in preparation for receiving the next strip of fabric 154. FIG. 13 illustrates tape 48 as it leaves station 172.

Figures 14, 15:
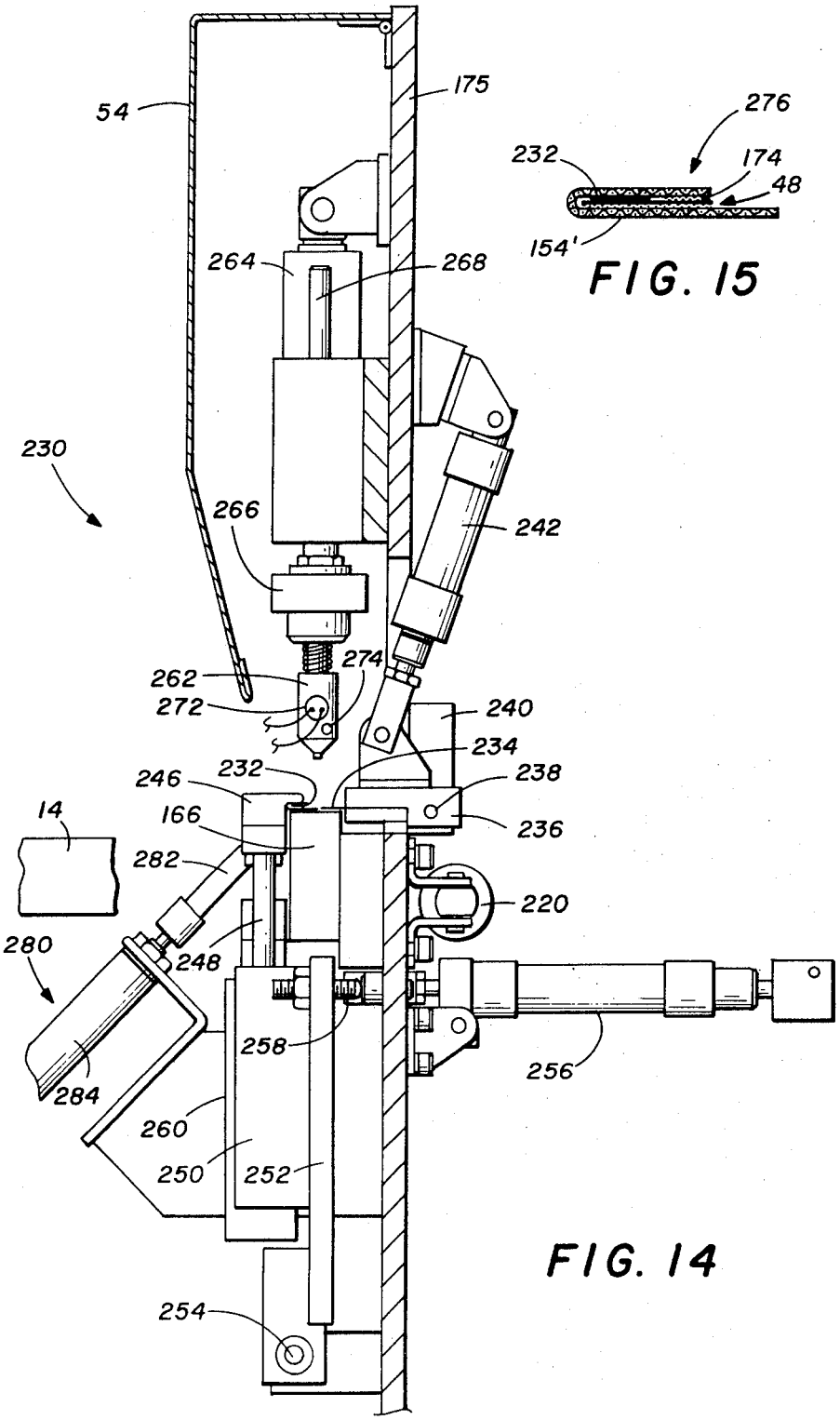
FIG. 14 is a sectional view taken along lines 14—14 of FIG. 8*b* in the direction of the arrows.
Figure 17:
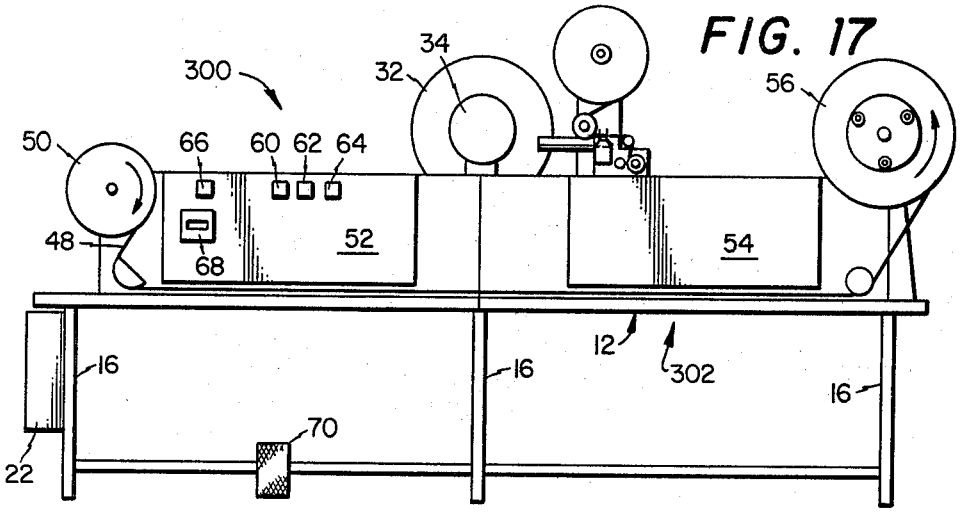
FIG. 17 is a reduced elevational view of a second embodiment of a system for prefabricating welts.

Referring now to FIGS. 8*b* and 14, the final station of the welt fabrication assembly 20 of system 10 comprises a bonding/folding station 230 wherein one side of each successive fabric strip 154 is folded over tape 48 and secured in place by means of adhesive 174. Tape 48 is advanced into position on a continuation of the support surface 166 and beneath both a fixed longitudinal stabilizer finger 232 and a movable head 234. The stabilizer finger 232 extends along the longitudinal edge of tape 48 opposite to that along which adhesive 174 is located, and functions as a longitudinal edge guide over which each successive strip of fabric 154 is folded.

As tape 48 is indexed into station 230, a movable tongue clamp 234 comes down to firmly engage the narrow portion of each corresponding strip of fabric 154 against the underlying support surface 166. Tongue clamp 234 is attached to a block 236 which is connected by means of a pivot 238 to a bracket 240 secured to the back of plate 175 as is best seen in FIG. 14. A double acting cylinder 242 actuates tongue clamp 234. FIG. 14 shows the tongue clamp 234 in a down position against the strip of fabric 154 attached to tape 48. Finger clamp 246 is also actuated to stabilize the free end of finger 232. The finger clamp 246 comprises a resilient foot actuated by a double acting cylinder.

After tape 48 has been clamped in place by tongue clamp 234 and finger 232 has been releasably secured by the finger clamp 246, folder 247 is actuated to fold the wide side of the fabric strip 154 over the finger. Folder 247 comprises a generally inverted L-shaped member attached to the ends of a pair of rods 248, each of which is mounted for movement in a block 250 secured to a plate 252. Plate 252 is supported by pivot 254 on plate 175 for pivotal movement in a direction transverse to the path of tape 48. Lateral movement of folder 247 is controlled by a double acting cylinder 256 coupled between plates 175 and 252, and an adjustable stop 258 is provided for limiting lateral travel of the folder relative to tape 48. Cylinder 260 mounted on plate 252 controls vertical movement of the folder 247, which can thus be articulated both vertically and laterally relative to the tape. Normally, folder 247 is positioned outwardly with respect to tape 48. Once tape 48 is properly positioned and releasably clamped in place on the support surface 166, folder 247 is actuated upwardly by cylinder 260 and then inwardly by cylinder 256 before being actuated downwardly by cylinder 260 to fold one edge of the strip of fabric 154 over tape 48.

Once the fabric strip 154 has been folded over tape 48 and the adhesive 174 thereon, head 262 is actuated downwardly by cylinder 264 thereby activating the adhesive and bonding the folded fabric to tape 48 to complete formation of a welt. As in station 172, the head of station 230 is attached to the bottom ends of a pair of rods 268 mounted for movement in guide blocks 270 secured to plate 175. Head 262 preferably includes an internal electrical resistance element 272 and associated temperature sensor or thermocouple 274 for heating the head in a controlled manner sufficient to activate the adhesive 174. Alternatively, an internal ultrasonic or radio frequency source, or an external source of radiation or heat could be utilized with head 272 for effecting activation of the adhesive. After head 262 has cycled, folder 247 is raised by cylinder 260 while finger clamp 246 and tongue clamp 234 are released permitting tape 48 and the welts thereon to travel around roller 278 and be wound on reel 56 by motor 58. FIGS. 15 and 16 illustrate tape 48 with completed welts 276 thereon as it leaves station 230.

With further reference to FIG. 14, station 230 can be provided with an optional alignment assembly 280 at either end of the folder 246 for locating tape 48 and each strip of fabric 154 thereon in proper position before the operational sequence of the station is initiated. Assembly 280, which includes a movable blade 282 driven by a double acting cylinder 284, functions substantially similarly to assembly 114 described hereinbefore in connection with FIG. 5.

A second embodiment of the present invention is illustrated in FIGS. 17–24 as system 300. Many elements of system 300 are identical to those found in system 10 and are identified by the identical reference numerals. The system 300 is mounted on a table 12 with a facing strip fabrication assembly 18 on one side of the table in a manner identical to system 10. However, system 300 includes a welt fabrication assembly 302 on the other side of the table which is modified from the welt fabrication assembly 20 of system 10.

The welt fabrication assembly 302 includes a supply roll 50 at its forward end containing adhesive backed fabric tape 48. The fabric tape 48 is directed along a path through bonding, advancing, trimming, adhesive applicating and folding/bonding stations located behind covers 52 and 54 to a take-up reel 56. The take-up reel 56 is rotated and driven by a motor 58.

Several controls are provided for operating the assembly 302. A thread button 60, stop button 62, jog button 64 and motor on/off button 66 are mounted on the cover 52 for use by the operator of assembly 302 in a similar fashion to the buttons on assemblies 18 and 20. A counter 68 is provided for monitoring the operation. A foot switch 70 controls advancement of the tape 48 through the assembly 302.

The structural details of the bonding, advancing and trimming stations of assembly 302 are substantially identical to those described above in assemblies 18 and 20. However, a welt position sensor 304 is provided to ensure proper positioning of the strips or pieces of fabric 154 between the anvil 90' and locator block 110' for bonding to the fabric tape 48. The welt position sensor 304 includes two photo sensors 306 and 308 spaced a distance X apart on the backup anvil 90' in the direction of motion of the tape 48 as best seen in FIGS. **18*A* and 18*B***.

Figure 18A:
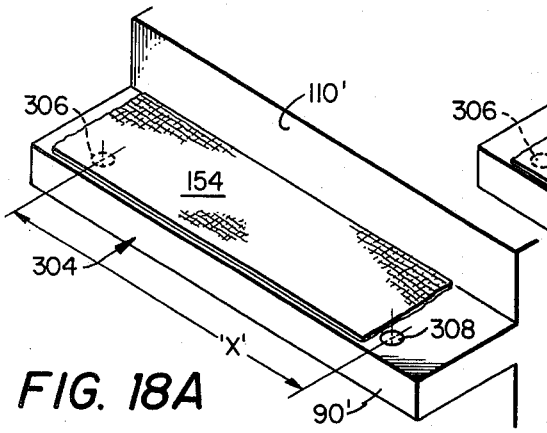
FIGS. 18*A* and 18*B* are schematic views of photosensors employed to ensure proper positioning of a fabric section for attachment to the tape.
Figure 18B:
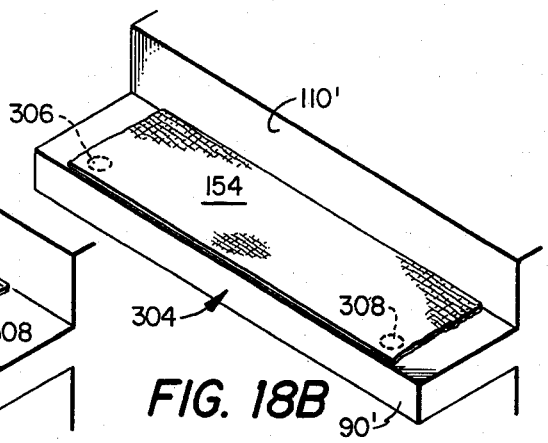

The operator manually places a strip of fabric 154 on anvil 90' against the block 110' and beneath the fabric tape 48. The adhesive 152 on the fabric tape 48 faces down for contact with the fabric 154. The sensors 306 and 308 are spaced so that a properly positioned strip of fabric covers both photosensors as illustrated in FIG. **18*B*. A strip of fabric which is misplaced from a central position on the anvil 90' will not activate both photosensors as seen in FIG. 18*A*. The system can be provided with controls reacting to the photosensors to activate an improper position warning signal or even cease operation of the system until the strip of fabric is properly positioned. After positioning, the head 88' descends to clamp and bond the strip of fabric 154 to the fabric tape 48**.

A transfer subassembly 86' advances the tape 48 and attached strips of fabric 154 through the assembly 302. A trimming station 156 acts to trim each fabric strip 154.

Figure 21:
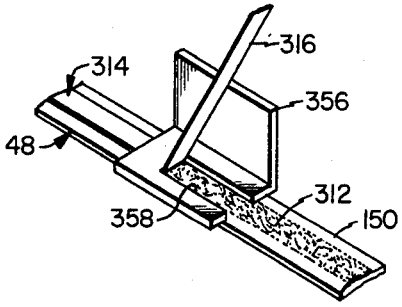
FIG. 21 is a schematic view of the second tape backing separator employed in the system forming the second embodiment.

The strips of fabric and tape 48 are then advanced to an adhesive application station 310 mounted on table 12 and a vertical plate 311. The function of the application station 310 is to apply a continuous strip of adhesive 312 along one edge of the top side of fabric 150 on the fabric tape 48 as best seen in FIG. 21. The adhesive 312 initially forms a portion of a second tape 314 which includes a flexible backing 316 and is stored on a supply reel 318.

Figure 19:
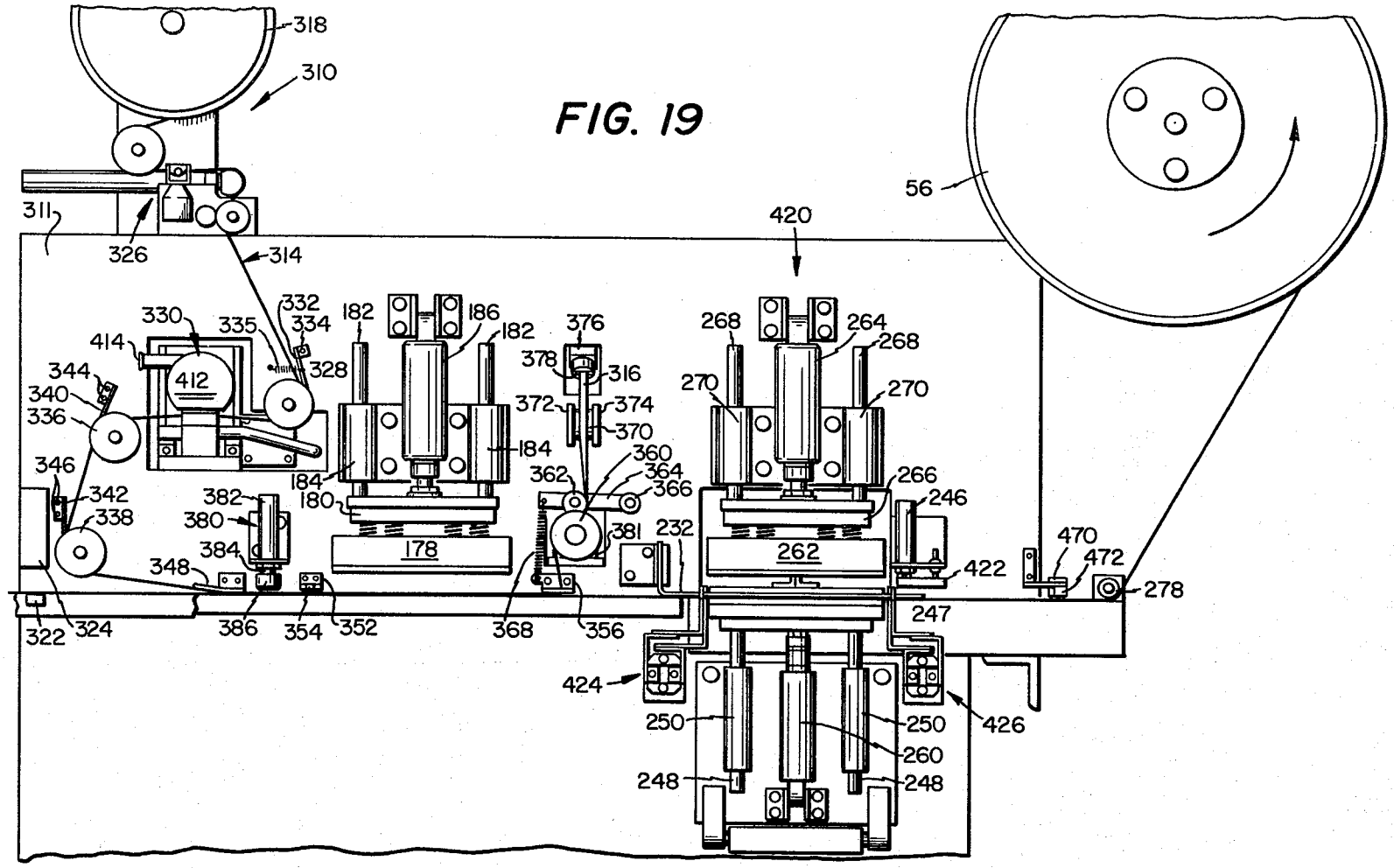
FIG. 19 is an enlargment of a portion of FIG. 17 showing the adhesive application/folding station section of the system.

Referring to FIG. 19, as the tape 48 and fabric strips 154 translate along the path of tape 48, the edges of the fabric pass over a reflector 322 embedded in the table 12. A photo switch 324 reacts to the cessation of light reflection from the reflector to activate the station 310.

The tape 314 from the supply reel 318 travels through a tape tensioning assembly 326. The tape is then threaded about a freely rotating roller 328 and into an adhesive cutting wheel assembly 330. An arm 332 is pivoted to pin 334 in plate 311. A spring 335 urges the arm against roller 328 to provide a force to maintain the tape 314 on the roller 328.

The tape 314 is then threaded about freely rotatable rollers 336 and 338. Fixed arms 340 and 342 are mounted by fasteners 344 and 346, respectively, to plate 311 to retain the tape on the rollers 336 and 338. The tape travels beneath a positioning plate 348 having a curved forward surface to gently curve the tape into a plane parallel and closely proximate the top side of the fabric 150 on the tape 48.

Tape 48, tape 314 and the fabric strips 154 travel between a spring loaded clamp 352 and the top of table 12. The clamp 352 includes a spring 354 which urges the tapes against the top of table 12. The tapes and fabric strips then pass beneath a head 178 to bond the adhesive layer 312 of tape 314 to the tape 48. The tapes 48 and 314 with fabric strips 154 subsequently pass beneath a backing separator 356. A notch 358 in the separator 356 facilitates the removal of the backing 316 from the adhesive 312 as best seen in FIG. 21.

Referring again to FIG. 19, the backing 316 extends about a portion of a driven roller 360 with the backing 316 compressed between the roller 360 and a pinch roller 362. The pinch roller 362 is mounted on a lever arm 364 pivoted at one end to a pivot 366 on the plate 311. A spring 368 at the opposite end of the arm 364 urges the pinch roller 362 into engagement with the periphery of the roller 360 to grip the backing 316 therebetween. The backing is twisted 90° and over a roller 370 freely supported between two brackets 372 and 374. A nozzle 376 extends to a hole in the plate 311 and includes a slit 378 through which the backing extends. The nozzle is connected to a vacuum source (not shown) to collect the backing for eventual disposal.

The adhesive 312 is secured to the fabric 150 on tape 48 by the head 178 which operates as described above in assembly 20. A tape clamp 380 is provided and includes an air cylinder 382 operating a piston 384 with a resilient foot 386. The tape clamp 380 is actuated immediately prior to and during the clamping and heating of the tapes and fabrics by the head 178. A motor 381 mounted behind the plate 311 for rotating the driven roller 360 continously maintains a predetermined tension on the tape backing 316.

Figure 20:
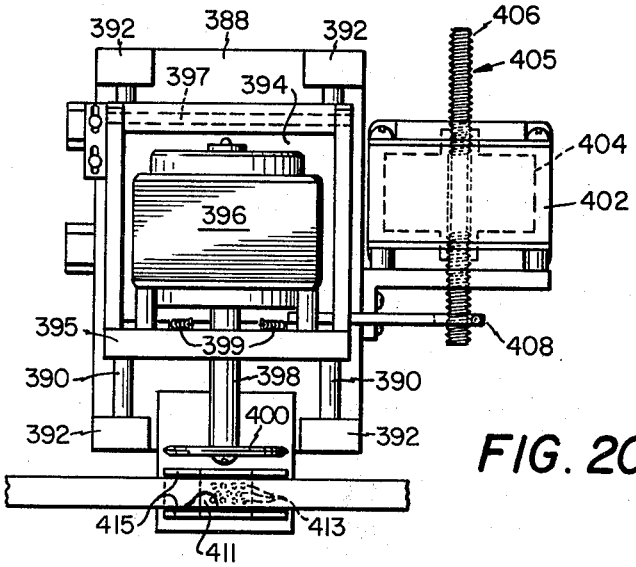
FIG. 20 is a schematic view of the traversing cutter wheel employed in the system forming the second embodiment.

The adhesive cutting wheel assembly 330 is best described with reference to FIGS. 19 and 20. A base 388 is rigidly fixed behind the plate 311. Dual parallel guide rods 390 are spaced from the upper surface of the base 388 at their ends and fixed by blocks 392 secured to the base. A movable platform 394 slides along the rods 390. A motor base plate 395 is mounted on and pivotal with respect to the platform 394 about a horizontal axis 397. The plate 395 mounts a cutting wheel motor 396. The cutting wheel motor includes a motor shaft 398 on which is mounted the circular cutting wheel 400. Springs 399 urge the plate 395 and wheel 400 downward toward the adhesive tape feedpath. A second, traversing motor 402 is fixed relative to the base 388 and includes a threaded internal motor armature 404. A shaft 405 extends through armature 404 having continuous threads 406. An arm 408 extends from the movable platform 394 and secures the shaft 405 therein. The traversing motor 402 is reversible for traversing the entire movable platform 394, motor 396 and cutting wheel 400 in a direction perpendicular to the motion of the ribbon 48.

The tape 314 passes over a convex shaped cutting shoe 411. The shoe 411 has holes 413 for vacuum suction to press the tape 314 against the shoe. As the platform 394 traverses toward the tape feedpath, cutting wheel 400 passes over sideplate 415 into the feed path to cut the adhesive layer 312. Plate 395 and cutting wheel 400 can pivot upward against springs 399 if an obstruction is encountered. A cover 412 is mounted over cutting wheel 400. Cover 412 includes a nipple 414 for attachment to a tube extending to a vacuum source for collecting scrap generated during the cutting process and for applying vacuum to the holes 413.

In the preferred operation, a fresh supply reel 318 with tape 314 is positioned on the assembly 302. The beginning of the tape is threaded about the aforementioned path. The adhesive cutting wheel assembly 330 is then activated to cut through the adhesive layer to leave a gap in the adhesive layer without structurally effecting the backing layer 316. When the gap approaches the backing separator 356, the gap facilitates separation of the adhesive and backing. In operation, a device incorporating features of the present invention showed a gap of about ½ inch length to be satisfactory. Preferably the adhesive cutting wheel assembly 330 is actuated to cut gaps at predetermined locations along the length of the tape 314 so that the length of adhesive 312 between gaps is of the proper length and position to correspond to the fabric strips 154 secured to tape 48.

The final station of the welt fabrication assembly 302 is the bonding/folding station 420 wherein one side of each successive fabric strip 154 is folded over tape 48 and secured in place by the adhesive 312. The tape 48 with fabric strips 154 and adhesive 312 is advanced beneath a fixed longitudinal stabilizer finger 232 and movable head 262. The stabilizer finger 232 extends along the longitudinal edge of tape 48 opposite to that along which the adhesive 312 is located. The finger 232 functions as a longitudinal edge guide over which each successive strip of fabric 154 is folded. Finger clamp 246 is provided for actuation downward to stabilize the free end of the finger 232. The finger clamp 246 comprises a resilient foot 422 on the end of a piston actuated by the double acting cylinder in the clamp.

A tongue clamp 234 is employed to firmly engage the narrow portion of each strip of fabric 154 against the underlying support surface 166. A folder 247 is actuated to fold the wide side of the fabric strip 154 over the finger 232. Once the fabric strip 154 has been folded over tape 48 and the adhesive 312, the head 262 is moved downwardly by a cylinder 264 to activate the adhesive and bond the folded fabric to tape 48 to complete formation of the welt.

Figure 22:
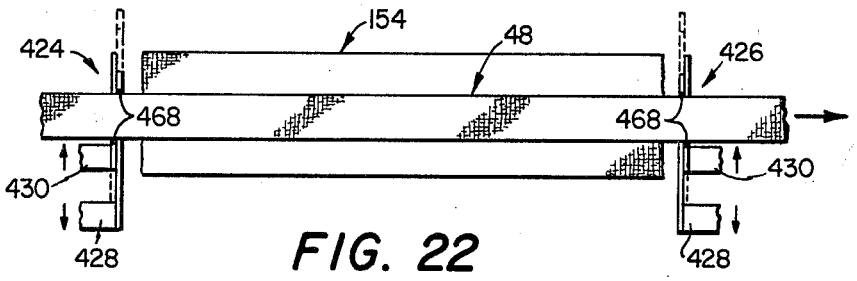
FIG. 22 is a schematic view of the positioning fingers positioning the fabric section and tapes in the folding station of the device forming the second embodiment.

To ensure proper location of the tape 48 and fabric strip 154 for folding and bonding, first and second positioning assemblies 424 and 426 are provided on either side of the folder 247 and head 262. The assemblies 424 and 426 act to center the tape 48, and therefore also the fabric strips 154, in the direction perpendicular the path of motion of the tape 48 as best seen in FIG. 22. Each centering assembly includes a front and back finger 428 and 430, respectively, which move toward the tape to center the tape at a predetermined position immediately prior to folding and bonding.

Figure 23:
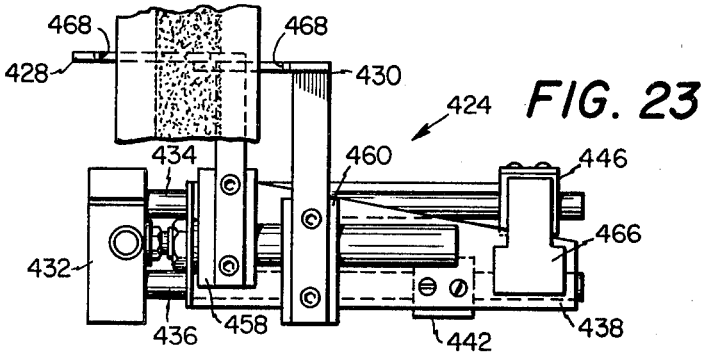
FIG. 23 is a top view of the positioning finger mechanism.
Figure 24:
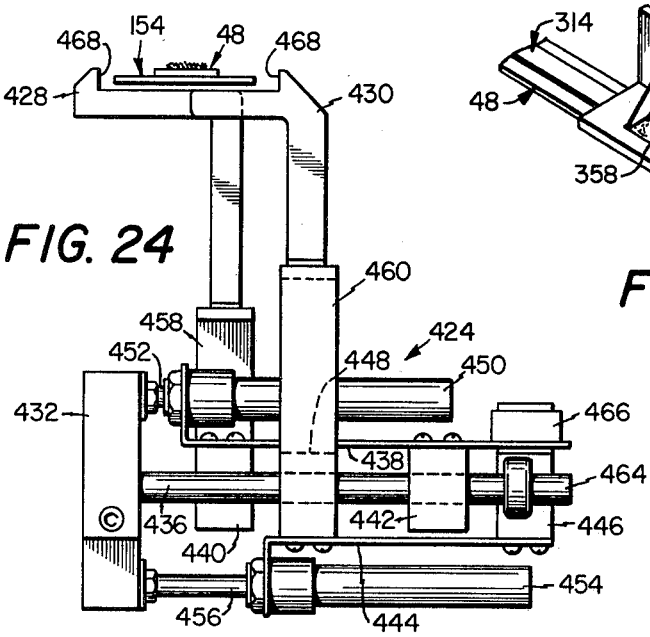
FIG. 24 is a side view of the positioning finger mechanism.

The detail of assembly 424 is best described with reference to FIGS. 23 and 24. Each assembly is substantially identical and the description of assembly 424 will also serve to describe assembly 426. The assembly 424 includes a base plate 432 secured in a fixed relationship to the table 12. Two parallel rods 434 and 436 are rigidly fixed to the base plate 432 and extend outwardly therefrom. A front finger plate 438 is provided with offset blocks 440 and 442 having cylindrical holes formed therethrough for receiving the rods 434 and 436, respectively. The blocks permit the front finger plate 438 to slide in a horizontal direction perpendicular to the motion of the tape 48. A rear finger plate 444 is provided with offset blocks 446 and 448 having cylindrical apertures therethrough. The blocks 446 and 448 support the rear finger plate 444 on the rods 434 and 436, respectively. Again, the rear finger plate 444 is permitted to move only in a direction perpendicular the path of the tape 48.

A double acting air cylinder 450 is secured on the front finger plate 438. The free end of the piston 452 of the cylinder 450 is threaded into the plate 432. A double acting air cylinder 454 is mounted on the rear finger plate 444. The piston 456 of the cylinder 454 is also threaded into the base plate 432. The cylinders 450 and 454 therefore permit controlled motion of the plates 438 and 444 along the rods 434 and 436.

A front finger angle member 458 is secured to the front finger plate 438 and supports the front finger 428. A rear finger angle member 460 is secured to the rear finger plate 444 and supports the rear finger 430. Adjustable stops 462 and 464 are positioned along the rods 434 and 436, respectively. The stops limit motion of the front and rear finger plates. A switch 466 is also provided on the assembly for limiting the maximum separation of the fingers.

In operation, the cylinders 450 and 454 are operated to move the forward finger forward and the rearward finger rearward to provide a large gap for passage of the fabric strip 154 prior to folding and bonding. When the fabric strip 154 is properly positioned along the path of the tape 48, the cylinders are actuated to move the fingers together to position the tape between the vertical side edges 468 on the fingers. The front finger 428 moves rearward until the block 442 contacts the stop 464. The rear finger 430 moves forward until the block 446 contacts the stop 462. It is apparent that stops 462 and 464 may be adjusted on the rods to adjust the final position of the fingers and thereby properly position of tape 48. The stops 462 and 464 may also be used to adapt the system to different widths of tape 48.

After folding and bonding, the finished welt passes between a photoelectric source 470 and receiver 472. The finished welt is then wound onto the take-up reel 56 for use in subsequent manufacturing operations.

From the foregoing, it will be apparent that the present invention comprises a system for prefabricating strings of facing strips and welts which incorporates several advantages over the prior art. One important advantage involves the elimination of numerous manual operations which were heretofore required in the construction of such pocket components. Placement of fabric strips under an adhesive tape is the only manual step required during operation of the system herein. The strings of uniformly spaced pocket facing strips and welts so fabricated are particularly adapted for use in the automatic implantation of pockets into garment panels. Other advantages of the invention will be evident to those skilled in the art.

Although particular embodiments of the invention have been illustrated in the accompanying Drawings and described in the Detailed Description above, it will be understood that the invention is not limited to the embodiments disclosed, but is intended to embrace any alternatives, modifications and/or substitutions of elements falling within the scope of the invention as defined by the following claims.

We claim:

1. An apparatus for prefabricating a string of pocket welts, comprising:

structure for translating a fabric tape along a fabric tape feedpath from an input position to an output position, the feedpath permitting placement of a piece of fabric for forming a pocket welt adjacent the fabric tape along the feedpath;

means for adhesively securing the piece of fabric to the fabric tape along the fabric tape feedpath;

means for translating an adhesive tape along an adhesive feedpath, at least a portion of the adhesive feedpath being parallel and proximate at least a portion of the fabric tape feedpath, the adhesive tape having an adhesive layer and a backing layer;

means for adhesively bonding the adhesive layer of the adhesive tape to the combined fabric and fabric tape;

means for separating the backing layer from the adhesive layer of the adhesive tape;

means for folding and bonding a fabric piece on the feedpath to form a pocket welt;

means for positioning the fabric tape and fabric piece along a direction transverse the feedpath in said folding and bonding means for folding and bonding, said positioning means including first and second finger means each defining a positioning surface extending parallel to the feedpath and means for moving the finger means transverse the feedpath to engage opposite sides of the fabric tape extending generally parallel the feedpath and thereby positioning the fabric tape and fabric piece for folding and bonding; and means for folding a portion of the fabric piece into engagement with the adhesive layer to form a welt.

2. The apparatus of claim 1 further comprising adhesive tape cutting means for cutting the adhesive layer in the adhesive tape across the width of the tape and over a gap of predetermined length to facilitate the separation of the backing layer and adhesive layer.

3. The apparatus of claim 1 further comprising means for positioning the fabric piece for attachment to the fabric tape including first and second sensors for sensing the presence of the fabric piece, said sensors being separated by a predetermined distance so that both sensors are covered when the fabric piece is in the proper position along the fabric tape feedpath to permit multiple fabric pieces to be positioned along the fabric tape with a uniform separation between the pieces for facilitating automation of the apparatus.

4. The apparatus of claim 3 wherein said means for adhesively securing the fabric piece includes:

a backup anvil mounted for movement relative to the fabric tape feedpath, said first and second sensors being mounted on said backup anvil; and means for selectively actuating said backup anvil to raise each fabric piece into engagement with the fabric tape.

5. The apparatus of claim 1 wherein said means for bonding the adhesive layer of the adhesive tape to the fabric piece includes:

structure defining a planar surface parallel and proximate the fabric tape feedpath; and a head mounted for motion toward and away from the surface to clamp the fabric piece and tapes between said head and the surface, said head having means for activating the adhesive layer for bonding.

6. The apparatus of claim 1 wherein said means for translating the adhesive tape defining the adhesive tape feedpath includes:

a driven roller;

motor means for rotating said driven roller a pinch roller; and spring means for urging said pinch roller into contact with the outer periphery of said driven roller for clamping the backing layer of the adhesive tape therebetween, a constant tension being applied to the backing layer separated at said separating means by said motor means.

7. The apparatus of claim 6 further comprising a nozzle having a slit formed therein for attachment to a vacuum source, the backing layer being sucked into the slit by the vacuum for disposal.

8. The apparatus of claim 1 wherein said positioning means includes first and second finger means on each side of said folding and bonding means along the fabric tape feedpath, each of said finger means including:

a structure secured in a rigid relationship to said folding and bonding means;

a plate mounted to said structure for slidable motion in a direction perpendicular to the fabric tape feedpath;

a double acting fluid actuator positioned between said structure and moveable plate for moving the plate upon actuation thereof;

a limit stop for limiting the motion of said moveable plate in a first direction; and a finger mounted on said moveable plate defining the positioning surface thereon, actuation of said fluid acutator for moving the finger in the first direction moving the finger to a predetermined position for properly positioning the fabric tape.

9. The apparatus of claim 1, further including:

a rotatable fabric tape supply reel located at the input end of the fabric tape feedpath;

a rotatable takeup reel located at the output end of the fabric tape feedpath for collecting the welts;

motor means for driving said takeup reel; and tape clamp means for selectively immobilizing the fabric tape during bonding of the fabric piece thereto, adhering the adhesive layer and folding and bonding the fabric piece to prevent uncontrolled withdrawal of the fabric tape from said supply reel.

10. An apparatus for prefabricating a string of pocket welts, comprising:

structure for translating a fabric tape along a fabric tape feedpath from an input position to an output position;

a station for placement of a fabric piece for forming a pocket welt proximate the fabric tape along the fabric tape feedpath;

first and second position sensors mounted on said station at a predetermined separation in the direction of the fabric tape feedpath for detecting the presence of a fabric piece, said sensors being positioned at a separation generally equal to the length of the fabric piece along the feedpath so that both sensors detect the fabric piece when the fabric piece is properly positioned at said station to permit accurate placement of a plurality of fabric pieces along the fabric tape;

means for bonding the fabric piece to the fabric tape for transporting the fabric piece with the fabric tape;

a rotatable supply reel containing a length of adhesive tape having an adhesive layer and a backing layer;

an adhesive layer cutting assembly having a cutting wheel for cutting a gap in the adhesive layer of the adhesive tape across the width thereof;

a positioning plate;

a backing separator for separating the backing layer and adhesive layer, said positioning plate and backing separator providing a path for the adhesive tape parallel to and proximate a portion of the fabric tape feedback;

a drive roller;

a pinch roller urged in contact with said drive roller for compressing the backing layer therebetween, said drive roller maintaining a predetermined tension on the backing layer;

means for bonding the adhesive layer of the adhesive tape to the combined fabric tape and fabric piece between said positioning plate and the backing separator;

means for folding the fabric piece and bonding the fabric piece in the folded position with the adhesive layer, said means for folding and bonding including a folding finger extending along the fabric tape feedpath about which the fabric piece is folded;

first and second positioning assemblies provided on either side of the folding finger for centering the fabric tape and fabric piece along a direction transverse to the feedpath for folding and bonding, each of said finger assemblies including:

front and rear fingers, each finger having at least one positioning surface for contacting the fabric tape, said positioning surface extending generally parallel the feedpath;

a base;

front finger plate means for mounting said front finger and slidably mounted on the base for motion transverse the fabric tape feedpath;

rear finger plate means for mounting said rear finger and slidably mounted on the base for motion transverse the fabric tape feedpath;

front and rear actuator means for selectively moving said front and rear finger plate means, respectively, transverse the direction of the fabric tape feedpath;

limit stop means for limiting the motion of said front and rear finger plate means, respectively, to position said fingers with the surfaces thereon centering the fabric tape for folding and bonding.

11. The apparatus of claim 10 further comprising a cutting wheel assembly for cutting the adhesive layer of the adhesive tape across its width to create a gap in the adhesive layer facilitating separation of the backing layer and adhesive layer at the backing separator, including:

a base fixed relative to the adhesive tape feedpath;

a moveable platform mounted on said base for sliding motion transverse the adhesive tape feedpath;

a cutting motor having a cutting shaft and cutting blade thereon mounted on said moveable platform for cutting the adhesive layer;

motor means for reversibly traversing said moveable platform and cutter motor so that the cutting blade cuts a gap in the adhesive layer of the adhesive tape of predetermined width.

12. The apparatus of claim 10 further comprising a fabric piece positioning structure including:

a backup anvil mounted for movement relative to the fabric tape feedpath, said first and second sensors being mounted in said backup anvil; and means for selectively actuating said backup anvil to raise each fabric piece into engagement with the fabric tape.

13. The apparatus of claim 10 further including:

a rotatable supply reel of a fabric tape located at the input end of the fabric tape feedpath;

a rotatable take-up reel located at the output end of the fabric tape feedpath;

motor means for driving said take-up reel to maintain a constant tension on the fabric tape; and p1 tape clamp means for selectively immobilizing the fabric tape from said supply reel.

14. The apparatus of claim 10, wherein said folding and bonding means comprises:

clamp means for selectively immobilizing the fabric tape and one longitudinal edge of each fabric piece thereon;

folder means for selectively folding the other longitudinal edge of each fabric piece over said folding finger and adhesive layer on the other side of the fabric tape;

a head mounted for movement relative to the fabric tape feedpath; and means for selectively actuating said head to engage each folded fabric piece with the adhesive layer on the fabric tape for bonding.

15. A system for assembling a string of uniformly spaced pocket welts, comprising:

structure defining a fabric tape feedpath having input and output ends;

a rotatable supply reel of fabric tape located at the input end of the fabric tape feedpath, said fabric tape having an adhesive side and a nonadhesive side;

a positioning station along the fabric tape feedpath defining two intersecting surfaces, one surface being planar with the fabric tape and on the adhesive side thereof for placement of a fabric piece for forming a pocket welt between said one surface and the fabric tape, the other surface forming a guide for placement;

first and second sensors mounted in said one surface for sensing the fabric piece, said sensors separated a predetermined distance generally equal to the length of the fabric piece along the feedpath to indicate proper positioning of the fabric piece only when each sensor senses the fabric piece to permit accurate placement of a plurality of fabric pieces along the fabric tape;

means for adhesively securing the fabric piece to the fabric tape;

an adhesive layer positioning assembly for bonding an adhesive layer to the nonadhesive side of the fabric tape, including:

(a) a rotatable supply reel of adhesive tape, the adhesive tape having an adhesive layer and a backing layer;

(b) a positioning plate and backing separator separated to define a path for the adhesive tape parallel and closely proximate a portion of the fabric tape feedpath, said backing separator having a V-shaped notch therein for facilitating separation of the backing layer and adhesive layer of the adhesive tape;

(c) means for adhesively securing the adhesive layer of the adhesive tape to the nonadhesive side of the fabric tape between said positioning plate and backing separator;

(d) roller means for maintaining the separated backing layer under a predetermined tension; and (e) means for tensioning the adhesive tape between said supply reel and positioning plate;

a folding and bonding assembly for folding the fabric piece and bonding the piece to the adhesive layer on the fabric tape to form a pocket welt, said assembly including:

(a) a fold positioning finger in fixed relation to the fabric tape feedpath;

(b) means for folding the fabric piece over said finger; and (c) means for bonding the folded fabric piece to the adhesive layer; and first and second positioning finger assemblies on opposite sides of said folding and bonding asembly along the feedpath for positioning the fabric tape and fabric piece in a direction transverse the feedpath prior to folding and bonding, each of said assemblies including:

(a) a front finger defining a surface generally parallel to the feedpath for contacting the forward edge of the fabric tape and a rear finger having a surface generally parallel the feedpath for contacting the rear edge of the fabric tape;

(b) a base mounted in a fixed relation to the fabric tape feedpath and having two parallel rods extending therefrom perpendicular the fabric tape feedpath;

(c) a front finger plate mounted for sliding motion on said rods and mounting said front finger;

(d) a rear finger plate mounted for sliding motion on said rods and mounting said rear finger;

(e) double acting fluid actuators mounted between each of said finger plates and said base for selective and independent motion of each finger; and (f) stops mounted on said rods for limiting the motion of each of said fingers, said stops limiting motion of said fingers so that the fabric tape is positioned for folding and bonding between the surfaces of said fingers.

16. The system of claim 15 further comprising an adhesive layer cutting wheel assembly for cutting a gap in the adhesive layer in the adhesive tape between said adhesive tape supply reel and positioning plate for facilitating the separation of the backing layer and adhesive layer, said assembly including:

a base fixed relative to the adhesive tape feedpath;

a moveable platform slidably mounted for motion transverse the adhesive tape feedpath;

a cutter motor having a motor shaft and cutter wheel thereon mounted on said moveable platform for rotating the cutting blade; and means for traversing the moveable platform and cutting wheel over the adhesive tape feedpath for cutting a gap across the width of the adhesive tape in the adhesive layer.

17. The apparatus of claim 15 further comprising:

a rotatable supply reel of fabric tape located at the input end of the fabric tape feedpath;

a rotatable takeup reel located at the output end of the fabric tape feedpath;

motor means for driving said takeup wheel; and tape clamp means for selectively immobilizing the fabric tape to prevent uncontrolled withdrawal of fabric tape from said supply reel.

* * * * *

UNITED STATES PATENT AND TRADEMARK OFFICE

CERTIFICATE OF CORRECTION

PATENT NO. : 4,451,319

DATED : May 29, 1984

INVENTOR(S) : Joseph W.A. Off, et al.

It is certified that error appears in the above-identified patent and that said Letters Patent is hereby corrected as shown below:

Column 7, line 23, "84" should be --84'--.

Column 17, line 24, after "and" delete "pl tape".

Column 17, line 25, before "clamp" insert --tape--.

Signed and Sealed this

*Nineteenth* Day of *February 1985*

[SEAL]

*Attest:*

DONALD J. QUIGG

*Attesting Officer*

*Acting Commissioner of Patents and Trademarks*